United States Patent [19]

McCabe

[11] Patent Number: 4,885,853

[45] Date of Patent: Dec. 12, 1989

[54] SPREADER FEEDER APPARATUS

[75] Inventor: Stanley G. McCabe, Lubbock, Tex.

[73] Assignee: Jensen Corporation, Ft. Lauderdale, Fla.

[21] Appl. No.: 314,177

[22] Filed: Feb. 23, 1989

[51] Int. Cl.[4] ..... D06F 67/04

[52] U.S. Cl. ..... 38/143; 38/8; 271/204

[58] Field of Search ..... 38/143, 8; 271/204; 414/13

[56] References Cited

U.S. PATENT DOCUMENTS

| | | | |
|---|---|---|---|
| 3,664,046 | 5/1972 | Thompson | 38/148 |
| 4,106,227 | 8/1978 | Allen et al. | 38/143 |
| 4,143,476 | 3/1979 | Holmes et al. | 38/143 |
| 4,378,645 | 4/1983 | Allen et al. | 38/8 |
| 4,411,083 | 10/1983 | Weir | 38/143 |
| 4,774,505 | 9/1988 | Ueda et al. | 38/143 |

*Primary Examiner*—Andrew M. Falik

*Attorney, Agent, or Firm*—Oltman and Flynn

[57] ABSTRACT

A spreader feeder apparatus for laundry flatwork pieces, such as bed sheets. The apparatus has a hanger for releasably gripping the opposite top corners of the flatwork piece and carrying the suspended flatwork piece away from the entry side of the apparatus and toward its exit side. The opposite side edges of the suspended flatwork piece are engaged by upper and lower sets of spreader belts, which spread it laterally in opposite directions. The upper sets of spreader belts release the flatwork piece after it has been spread, and pusher mechanisms push it onto a horizontal conveyor, which carries it toward the exit side of the apparatus.

17 Claims, 13 Drawing Sheets

SPREADER FEEDER APPARATUS

BACKGROUND OF THE INVENTION

This invention relates to an apparatus for spreading and feeding laundry flat work pieces before feeding them to subsequent processing equipment.

U.S. Pat. No. 4,106,227, assigned to the present assignee, discloses a spreader feeder apparatus for spreading laundry flatwork pieces before feeding them to subsequent processing equipment. Separate pairs of flatwork clamps are normally located respectively at the left end, middle and right end of the apparatus. The left end and right end clamps are movable straight across the entry side of the apparatus to the middle before being spread apart. The paired clamps operate to spread their respective flatwork pieces in the order in which their respective start switches are operated manually. Interference among the pair clamps or between clamps of each pair is prevented. No intermediate flatwork transfer operation is required between the insertion of a flatwork piece into a pair of clamps and the spreading of that flatwork piece.

U.S. Pat. No. 4,378,645, assigned to the present assignee, discloses a spreader feeder apparatus in which laundry flatwork pieces are spread apart by pairs of clamps, one pair of clamps at the left end, another pair of clamps at the right end, and a third pair of clamps at the center of the apparatus. The spread-out flatwork pieces are blown onto a conveyor for conveying them to the subsequent processing apparatus. Trailing edge sensors are positioned at different levels below the clamps to sense the upward passage of the bottom edge of the laundry flat piece deposited on the conveyor, and a selector switch enables one of the sensors and disables the other, depending upon the speed at which the conveyor is being operated. Proximity switches sense the positions of the clamps. There is an overlying conveyor cooperating with the main conveyor for sandwiching the laundry flat piece as it is moved into the apparatus for stretching purposes. The main conveyor can be moved to an extended position beyond the clamps to facilitate hand feeding of small laundry flat pieces without engagement by the clamps.

SUMMARY OF THE INVENTION

The present apparatus is for spreading laundry flatwork pieces, such as bed sheets, before feeding them to subsequent processing equipment, such an an ironer and a folder. In the present apparatus, each laundry flatwork piece has its opposite top corners inserted into a clamp at the entry side of the apparatus. The clamp is suspended from an endless conveyor and it carries the laundry flatwork piece away from the entry side of the apparatus and toward its exit side to upper and lower sets of spreader belts located on opposite sides of the clamp. The spreader belts of each set engage the flatwork piece and spread it apart, pulling it out of the clamp in doing so. After the upper spreader belts have spread the flatwork piece, the upper spreader belts release it and a pusher moves the released upper part of the flatwork piece onto a conveyor which carries it toward the exit side of the apparatus. The lower part of the flatwork piece becomes its trailing end, and this part is pulled up between the lower spreader belts. Air is blown onto the flatwork piece on the conveyor to make it lie substantially flat.

A principal object of this invention is to provide a novel spreader feeder apparatus for laundry flatwork pieces.

Another object of this invention is to provide a novel spreader feeder apparatus which spreads a laundry flatwork piece between upper and lower opposed sets of endless flexible belts on opposite sides of an entry location for the laundry flatwork piece.

Another object of this invention is to provide a novel spreader feeder apparatus having a transfer mechanism for depositing a laundry flatwork piece, after it has been spread, on a conveyor with improved precision and reliability.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Overall Operation

Figure 22:
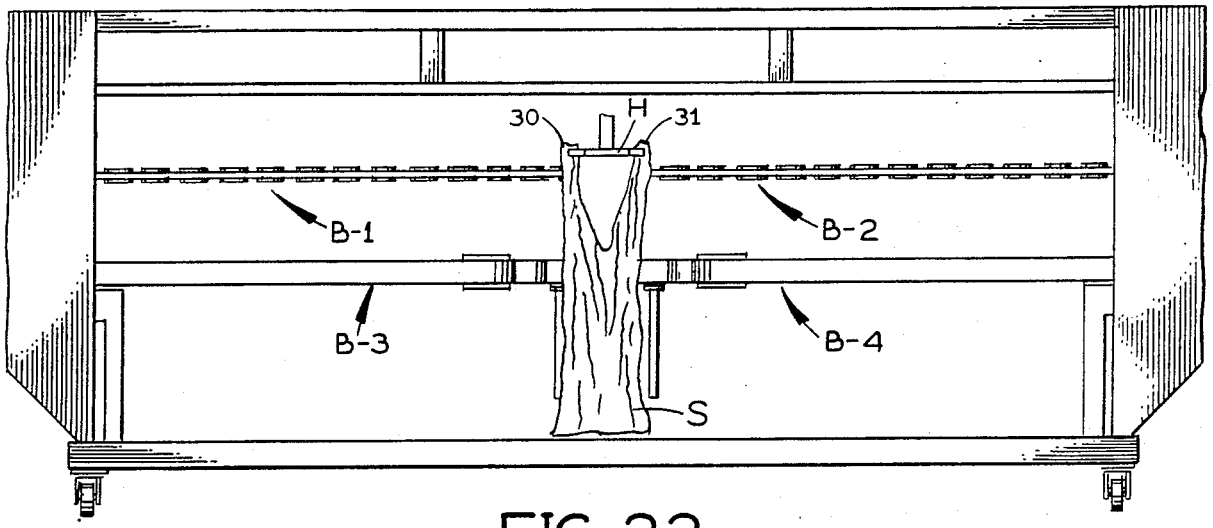
FIG. 22 is a front elevation of the machine, with parts omitted for clarity, showing a laundry sheet just after its insertion in one of the hangers.
Figure 23:
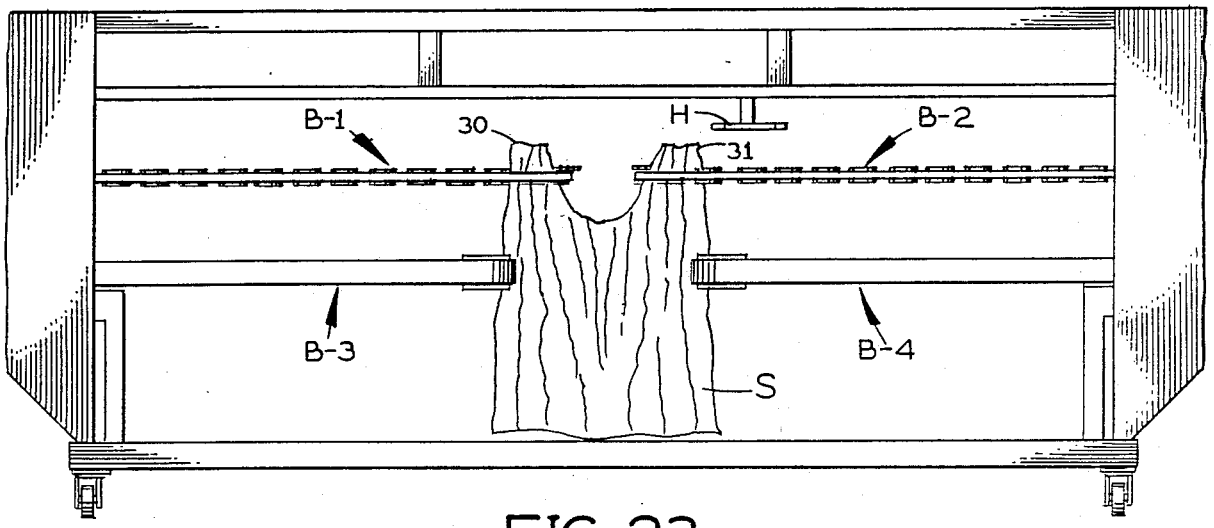
FIG. 23 is a similar view showing the laundry sheet after it has been moved from the entry side toward the exit side of the machine and then released by the hanger and engaged by the upper spreader belts.
Figure 24:
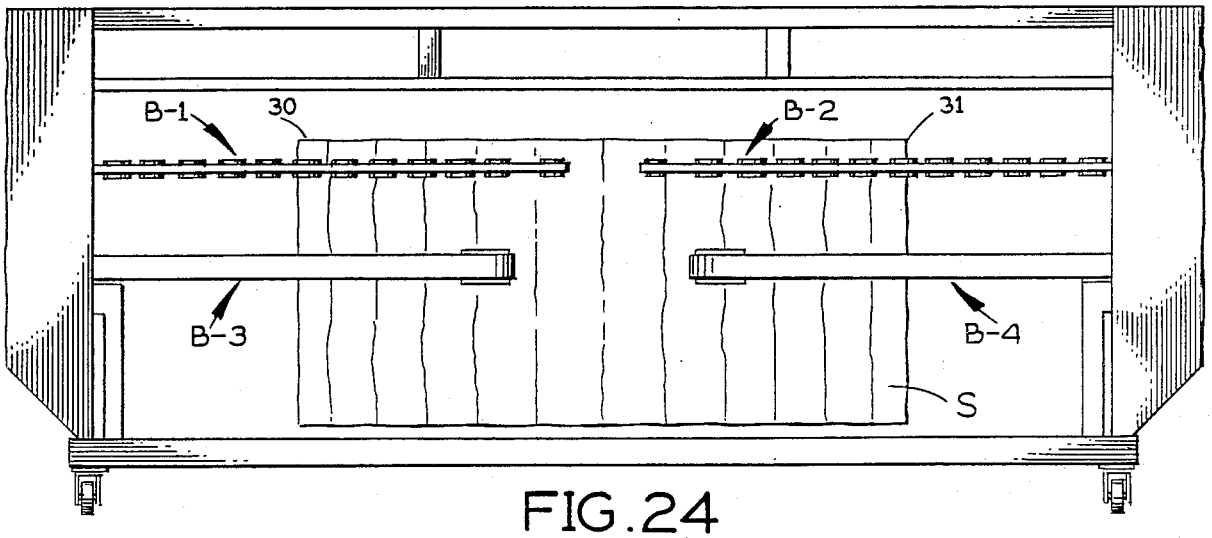
FIG. 24 is a similar view showing the sheets completely spread out by the upper spreader belts.

FIGS. 22–24 show a laundry flatwork piece, such as a sheet S, in successive stages as it is spread by the present apparatus. The opposite top corners 30 and 31 are manually inserted into a hanger H from opposite sides at the entry side of the machine and the hanger carries the suspended sheet into the machine, from its entry side toward its exit side, to opposite pairs of upper, endless, flexible spreader belts B-1 and B-2. Here, the belts of each pair of upper belts B-1 and B-2 engage the sheet tightly between them a short distance below their top corners and carry the opposite sides of the sheet horizontally in opposite directions laterally outward, as shown progressively in FIGS. 23 and 24. These belts pull the sheet loose from the grip of hanger H as its spreads the sheet laterally. At the same time, about midway down, the sheet passes between opposite pairs of lower spreader belts B-3 and B-4, which engage the sheet between them as its opposite side edges are spread apart by the upper belts B-1 and B-2. FIG. 24 shows the sheet spread apart substantially completely and hanging down from the upper pairs of belts B-1 and B-2.

After the sheet has reached the position shown in FIG. 24, a roller 32 (FIG. 8) is actuated to pinch the spread-apart sheet against a motor-driven horizontal roller 33 in front of a horizontal conveyor C. Then the upper pairs of belts B-1 and B-2 release the sheet and two laterally spaced pushers P are actuated to push the just-released top part of the sheet across roller 33 and onto the conveyor C, which carries it away from roller 33 toward the exit side of the machine. Air nozzles A blow air over the top of the sheet while it is on conveyor C.

Hangers

Figure 16:
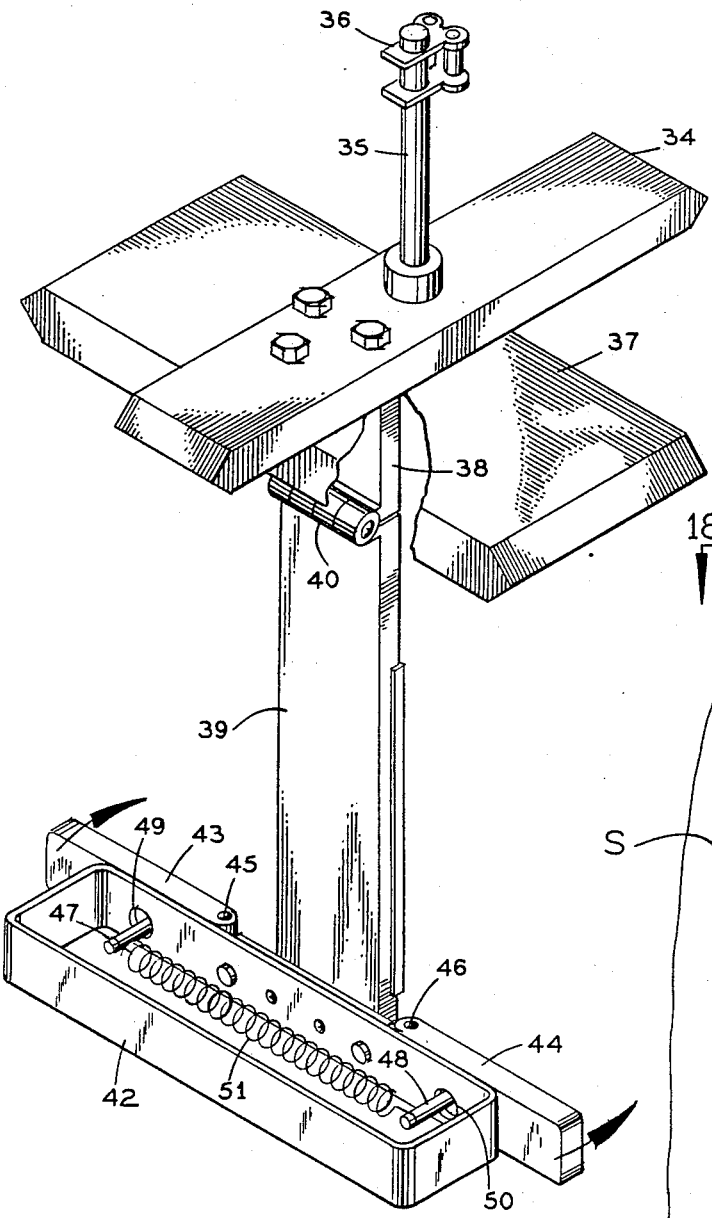
FIG. 16 is a fragmentary perspective view of one of the hangers in this machine.
Figure 17:
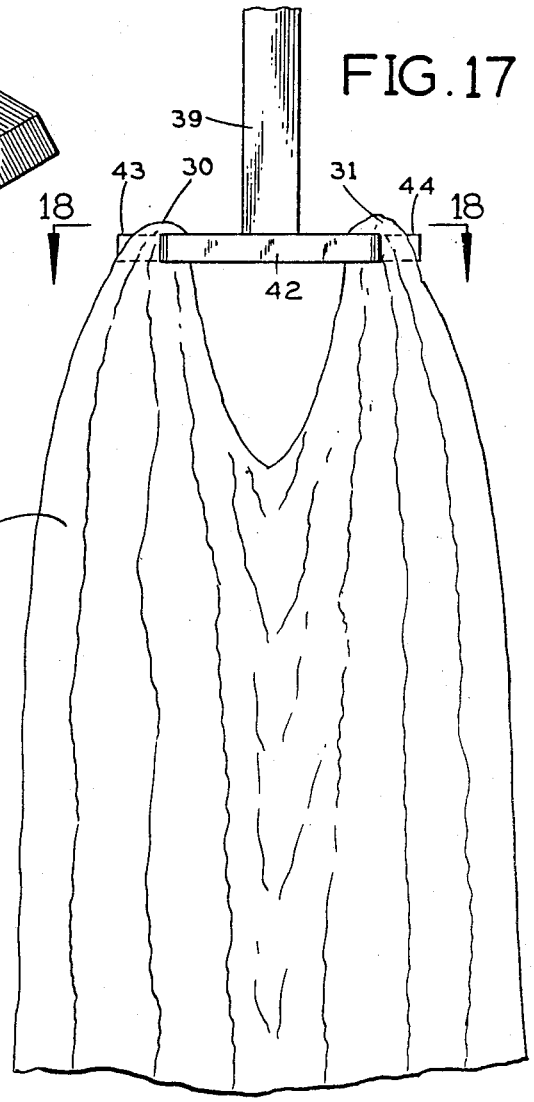
FIG. 17 is a front elevation showing a sheet suspended from a hanger of the type shown in FIG. 16.
Figure 18:
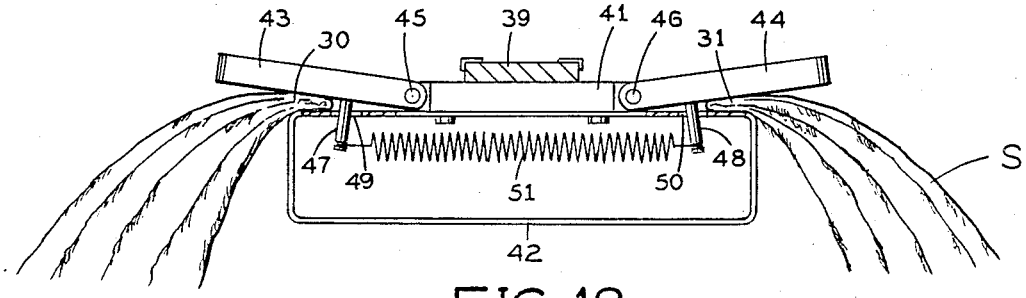
FIG. 18 is a horizontal section through this hanger, taken along the line 18—18 in FIG. 17.
Figure 19:
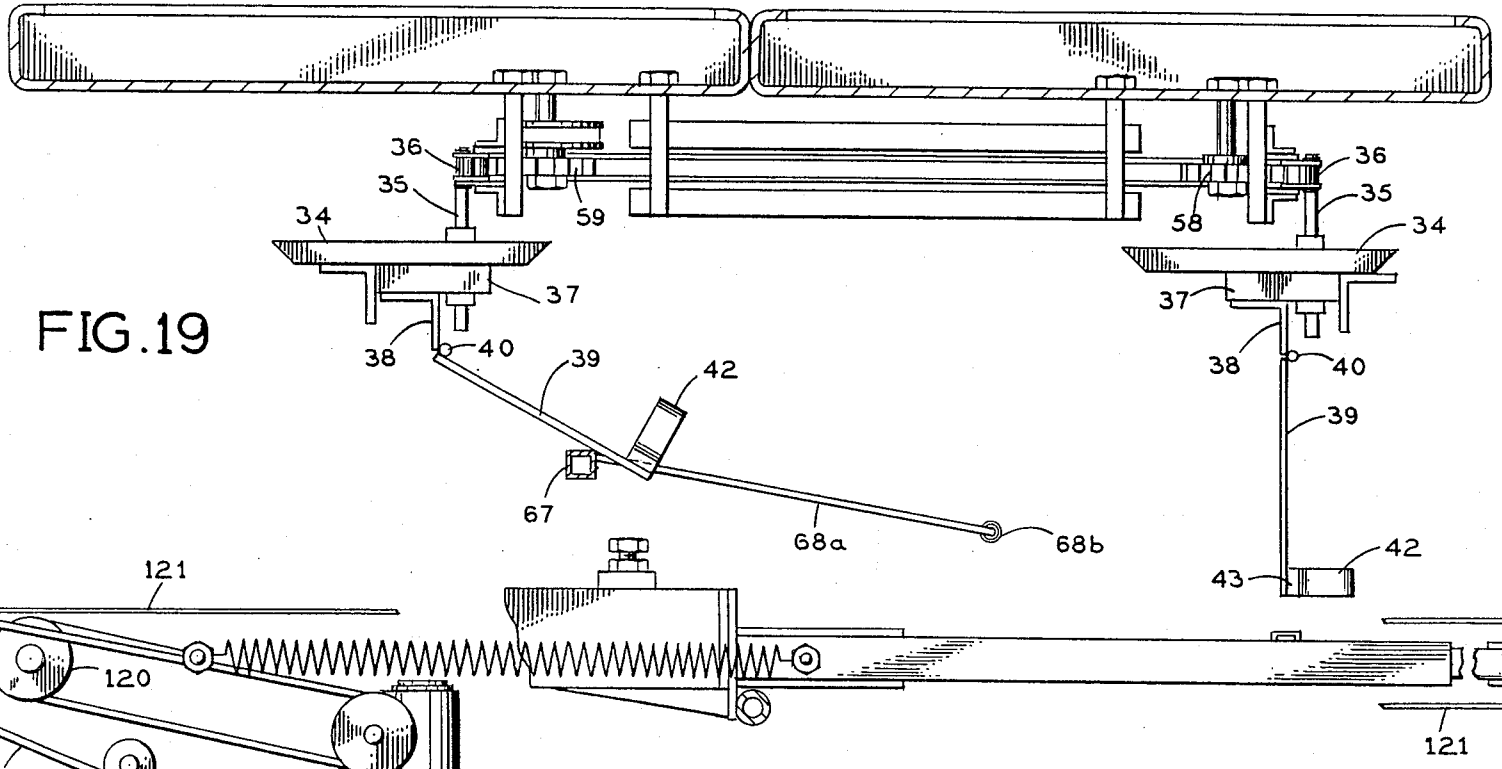
FIG. 19 is a fragmentary cross-section in the machine showing one hanger toward the entry side and another hanger toward the exit side of the machine.

FIGS. 16–18 show one of the hangers H in the present apparatus and FIG. 19 shows two of them in different phases of their operation.

Each hanger has a rigid horizontal top piece 34 attached to the lower end of a short vertical rod 35 extending down from one link 36 of an endless chain conveyor. A cross piece 37 is rigidly attached to the bottom of the top piece 34 and a right-angled piece 38 extends down from cross piece 37. A vertically elongated piece 39 is attached by a hinge 40 to the angle piece 38 at the latter's lower end. This hinge permits the vertically elongated piece 39 to pivot up clockwise in FIG. 16 from its normal vertical position shown there.

At the lower end of the vertically elongated piece 39, a connecting piece 41 (FIG. 18) is sandwiched between it and the back of an open rectangular frame 42 and provides a rigid connection between them. Clamping pieces 43 and 44 are pivoted to the connecting piece 41 at its opposite ends, at vertical pivots 45 and 46, respectively. These clamping pieces extend beyond the opposite ends of frame 42. The clamping pieces carry pins 47 and 48, respectively, which project forward into frame 42 through corresponding opening 49 and 50 in the back of the frame. A coil spring 51 has its opposite ends connected to pins 47 and 48 and it is under tension between them to normally hold the clamping pieces 43 and 44 flat against the back of frame 42. Each clamping piece 43 and 44 can be retracted pivotally to enable the corresponding top corner 30 or 31 of sheet S to be inserted between that clamping piece and the back of frame 42, as shown in FIG. 18. The hanger grips the top corners of the sheet until they are pulled out by the action of the upper belts B-1 and B-2 in spreading the sheet.

Figure 2:
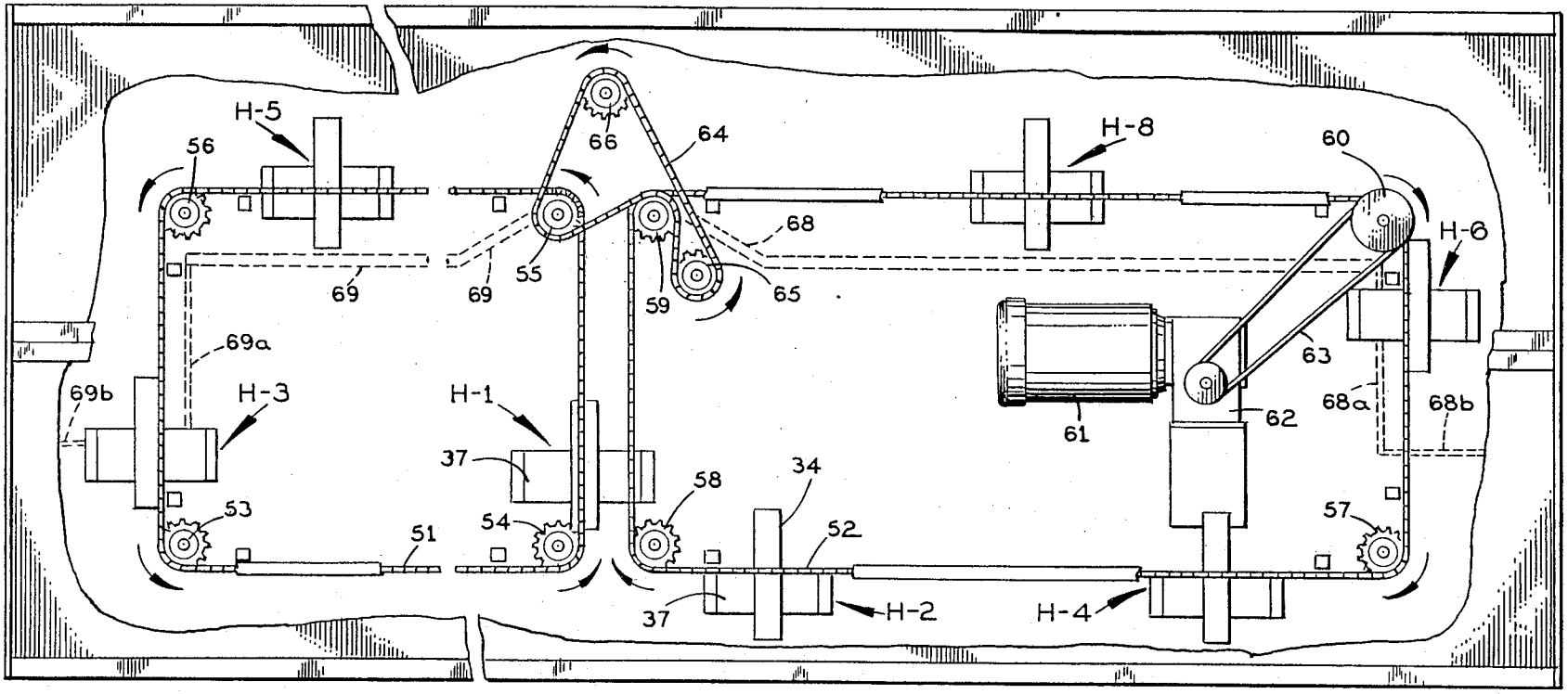
FIG. 2 is a horizontal longitudinal section taken along the line 2—2 in FIG. 1 near the top of the machine.

The present apparatus has several hangers as just described which are suspended from two endless chain conveyors above. Referring to FIG. 2, the apparatus has two endless conveyor chains 51 and 52 running in adjoining horizontal rectangular paths.

Conveyor chain 51 runs from left to right along the front leg of its course of movement from a front left-hand drive gear 53 to a front right-hand drive gear 54, then from the entry side of the machine along the inner leg of its course of movement to the lower gear of a rear right-hand double gear 55, then from right to left along the rear leg of its course of movement to a rear left-hand gear 56, and then along the outer leg of its course of movement toward the entry side of the machine from the rear left-hand gear 56 to the front left-hand gear 53. Chain 51 carries four hangers H at intervals along its length. Only three of these hangers appear in FIG. 2 because of the break in chain 51 in this Figure. These three hangers are designated individually in FIG. 3 as H-1, H-3 and H-5.

The other conveyor chain 52 runs from right to left along the front leg of its course of movement from a front right-hand gear 57 to a front left-hand gear 58, then from the entry side toward the exit side of the machine along the inner leg of its course of movement to the lower gear of a rear left-hand double gear 59, then from left to right along the rear leg of its course of movement to a rear right-hand gear attached to a pulley 60, and then toward the entry side of the machine along the outer leg of its course of movement from the rear right-hand gear to the front right-hand gear 57. The inner leg of the course of the course of movement of chain 51. Chain 52 carries four hangers H at intervals along its length, which are designated individually as H-2, H-4, H-6 and H-8 in FIG. 2.

Pulley 60 at the rear right-hand corner of chain 52 is driven from an electric motor 62 through a gear reduction 62 and an endless flexible drive belt 63. The drive to conveyor chain 52 is imparted to it through pulley 60 and the gear attached to it. Gears, 57, 58 and 59 are idler gears driven by chain 52. The drive to conveyor chain 51 is imparted to it from the upper gear of double gear 59 at the left rear corner of chain 52 through an auxiliary flexible endless chain 64 which runs counterclockwise in FIG. 2 from gear 59 to an idler gear 65, rearward and to the left to another idler gear 66, and from there forward and to the left to the upper gear of the double gear 55 at the right rear corner of chain 51, and around this gear and back over to gear 59. Gears 53, 54 and 56 are all idler gears driven by chains 51.

Figure 1:
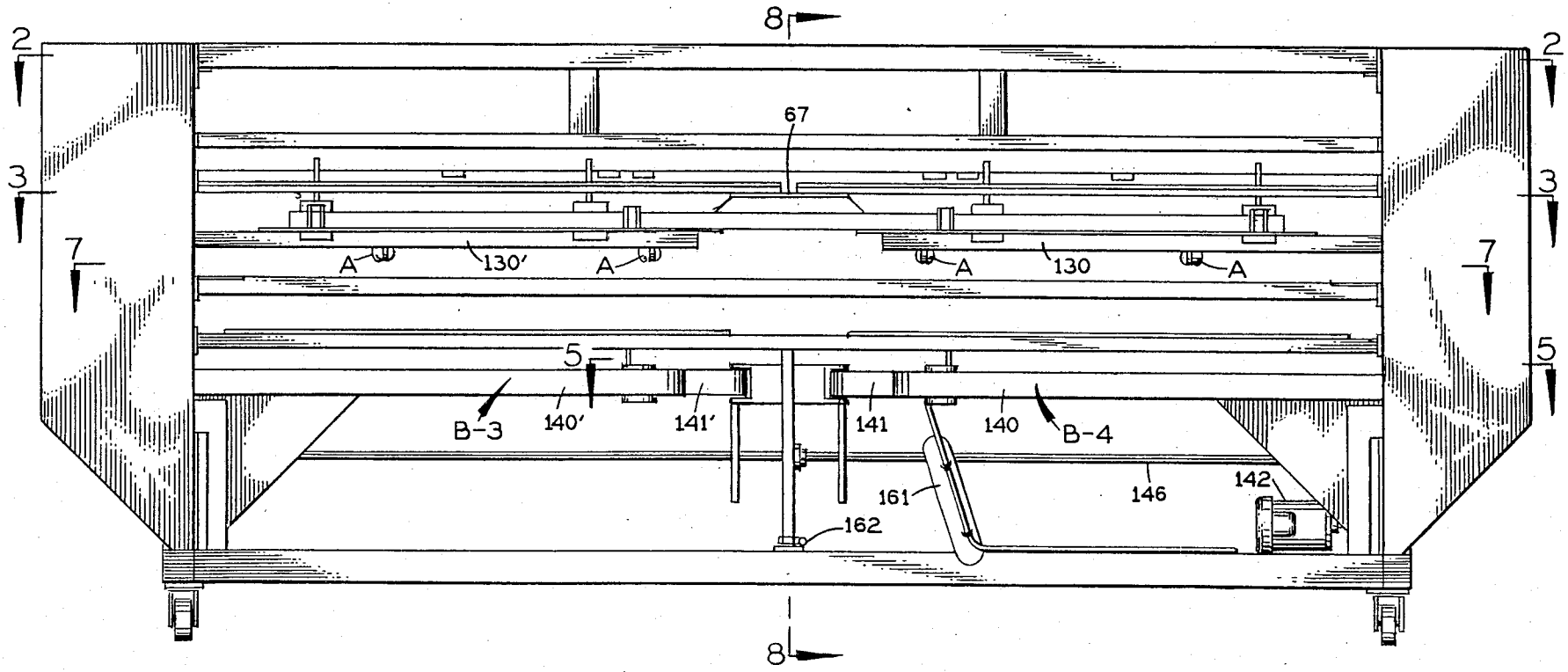
FIG. 1 is a front elevation of the present spreader-feeder.

FIG. 1 shows hanger H-1, which is suspended from chain 51, positioned just behind the front of the inner leg of this chain's course of movement. A sheet S will be inserted in hanger H-1 when it is at the start of its movement from the entry side toward the exit side of the machine along the inner leg of its course of travel. The other hangers move to this sheet-insertion position in the following sequence after H-1: H-2, H-3, H-4, H-5, H-6, the hanger on chain 51 which does not appear in FIG. 2, H-8, and then H-1 again.

Figure 8:
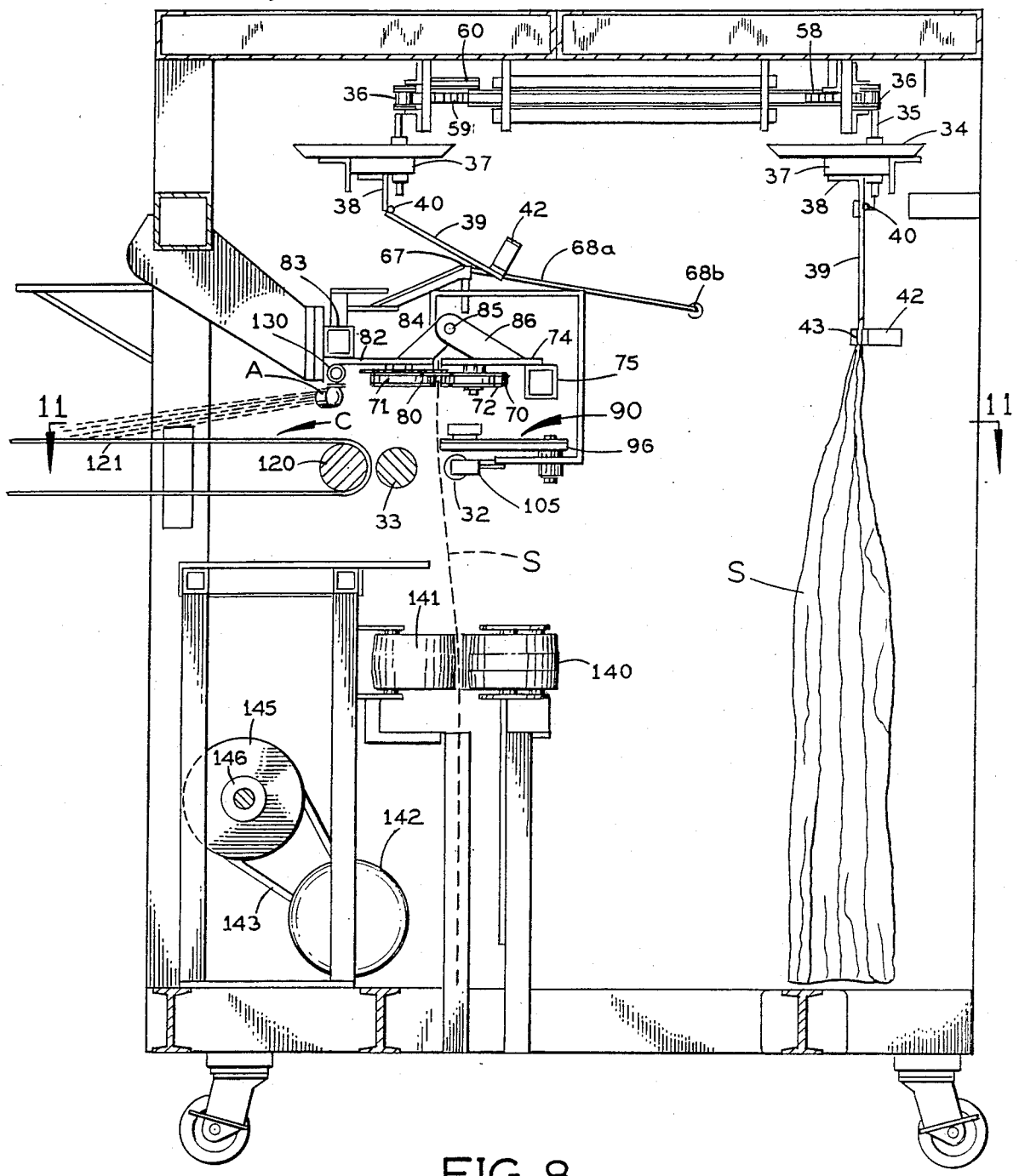
FIG. 8 is a vertical cross-section taken along the line 8—8 in FIG. 1.

Referring to FIG. 19, when one of the hangers on chain 52 away from the entry side of the machine back along the inner leg of its course of movement, its vertically elongated piece 39 strikes a fixed horizontal bar 67, which causes it to pivot up about the hinge 40 at its upper end and to slide up across bar 67 as the hanger continues to move away from the entry side of the machine. As shown in FIG. 8, this raises the hanger up out of the way of a mechanism below, which will be described in detail hereinafter. As this hanger turns the rear inside corner of its conveyor chain, its lower end continues to slide over an elongated rod 68 (FIGS. 2 and 8) which extends horizontally to the right almost to the outer leg of the course of travel of chain 52 and then toward the entry side of the machine and downward at a slight angle, as shown at **68*a* in these Figures, and then horizontally laterally outward past this part of chain 52, as shown at 68*a* in FIG. 2**. This rod keeps the hanger H raised until it is completely past the mechanism below that it would interfere with if it hung straight down.

A similar guide rod 69 (FIG. 2) extends to the left of plate 67 to keep each hanger on chain 51 raised until it almost reaches the beginning of the front leg of its course of travel. Guide rod 69 is a mirror image of guide rod 68.

Upper Spreader Belts

Figure 3:
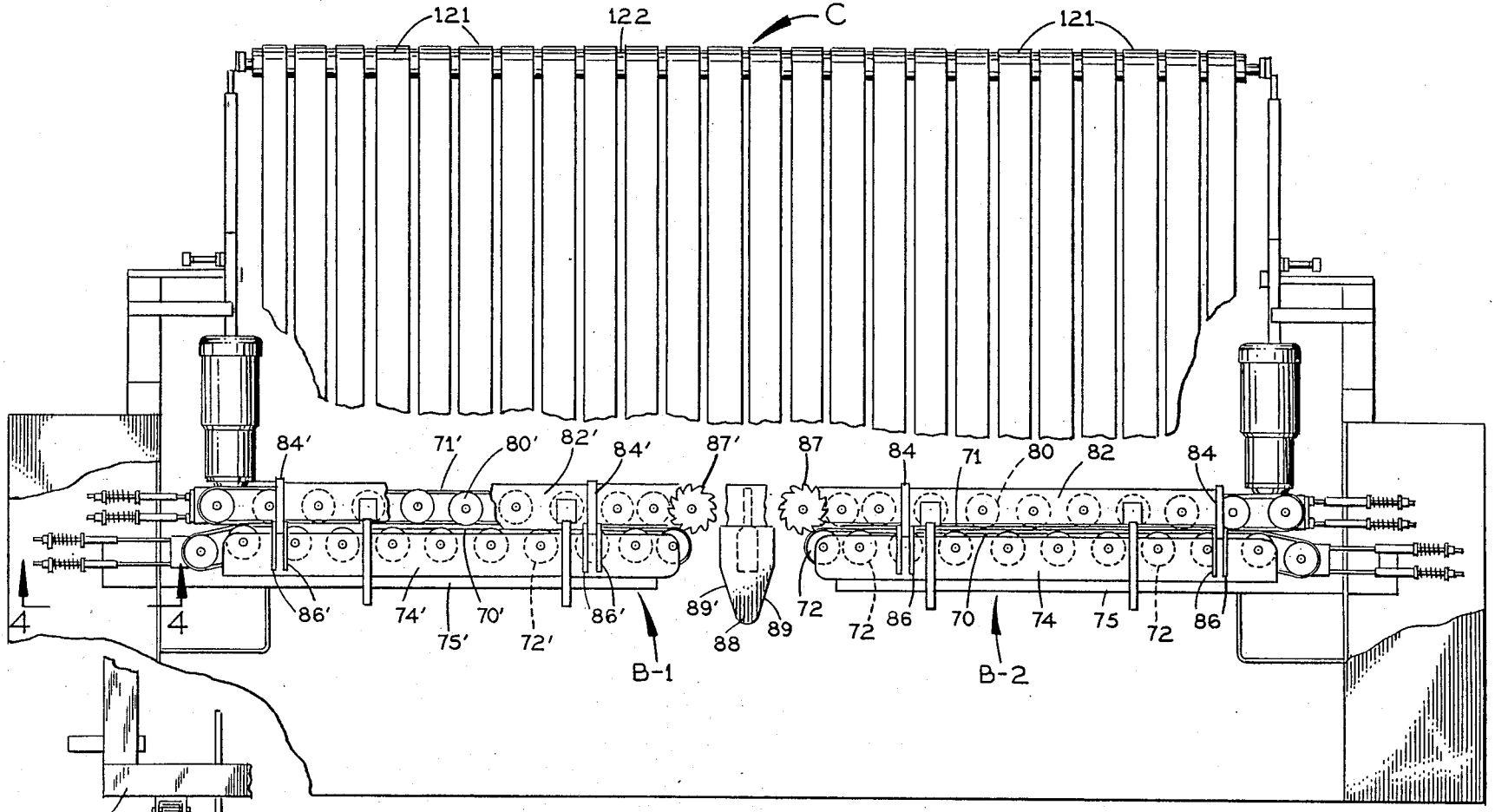
FIG. 3 is a similar view taken along the line 3—3 in FIG. 1.
Figure 9:
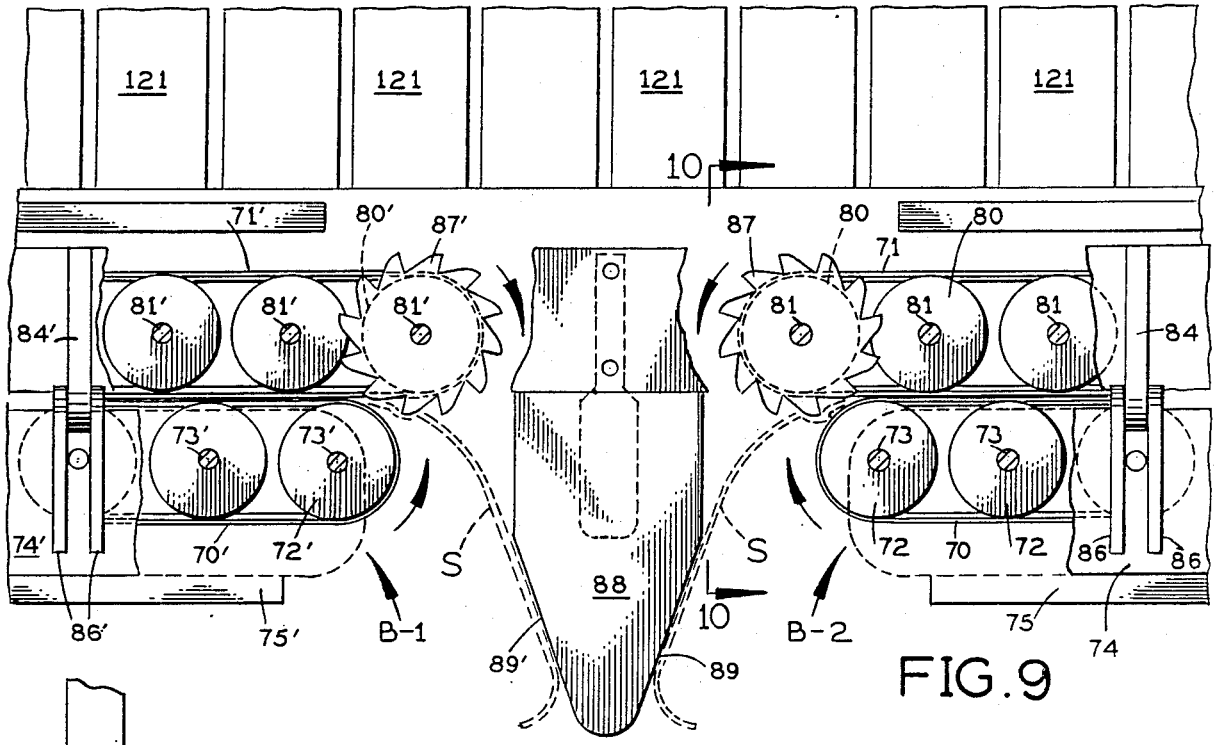
FIG. 9 is a fragmentary view on an enlarged scale at the same location as FIG. 3, looking down on upper spreader belts in the machine.
Figure 10:
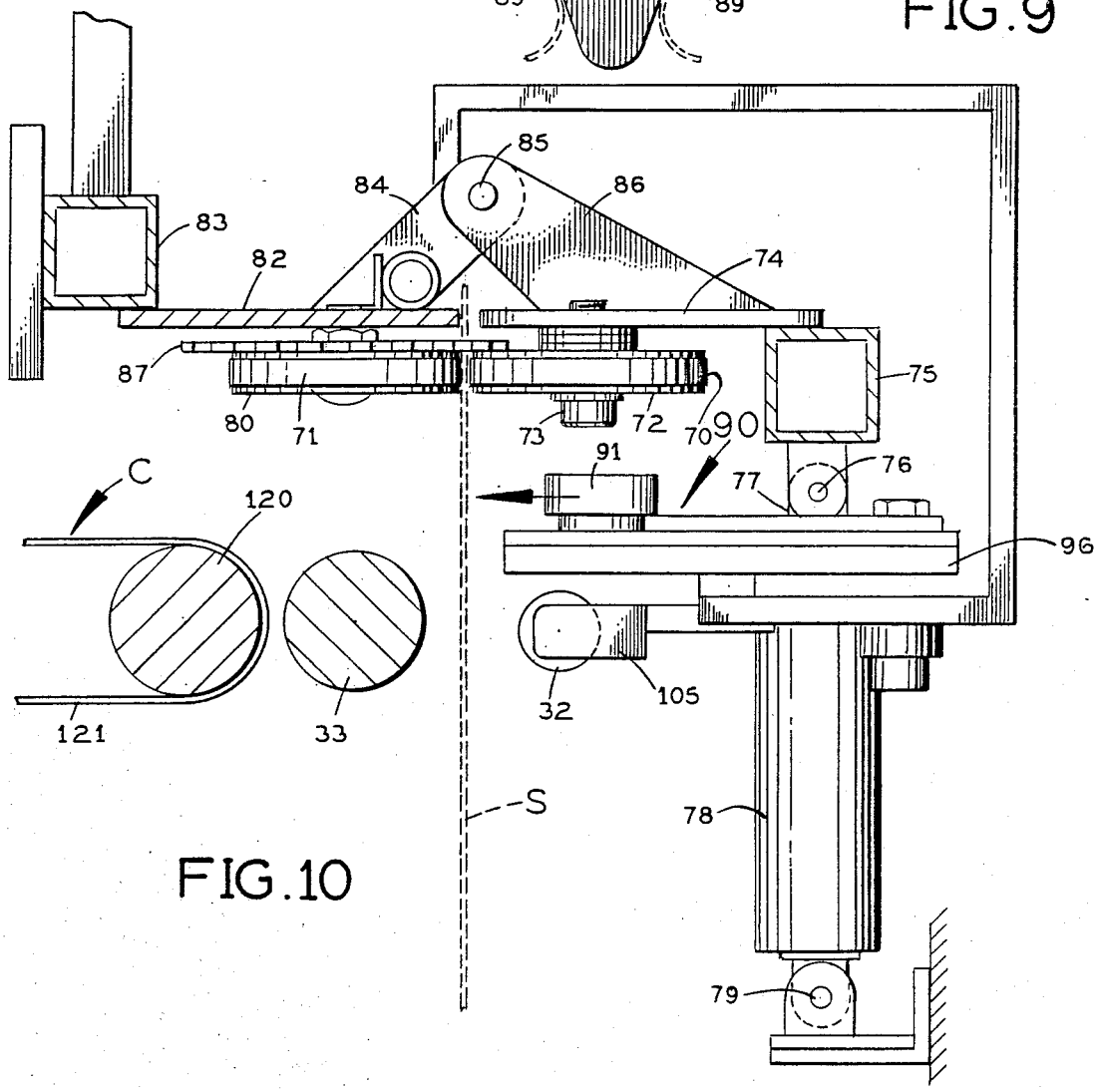
FIG. 10 is a fragmentary vertical cross-section taken along the line 10—10 in FIG. 9.

Referring to FIG. 9, to the right of the centerline of the machine the upper spreader belts B-2 consist of a front endless flexible belt 70 and rear endless flexible belt 71. The front belt 70 passes across the front of a series of front pulleys 72 and then across the back of these pulleys, which are spaced apart in close succession from left to right. The front pulleys 72 are rotatably mounted individually on respective axles 73 which extend down from a normally horizontal support plate 74 (FIG. 10). As shown in FIG. 3, support plate 74 is elongated from left to right on the right side of the longitudinal centerline of the machine. In front of the pulleys 72, support plate 74 is rigidly attached to the top of a cross-piece 75 (FIG. 10) hollow, square cross-section. This cross-piece is pivotally attached below, at 76, to the upper end of a piston rod 77 (FIGS. 4 and 21) operating in an air cylinder 78 whose lower end is pivotally supported at 79.

Figure 21:
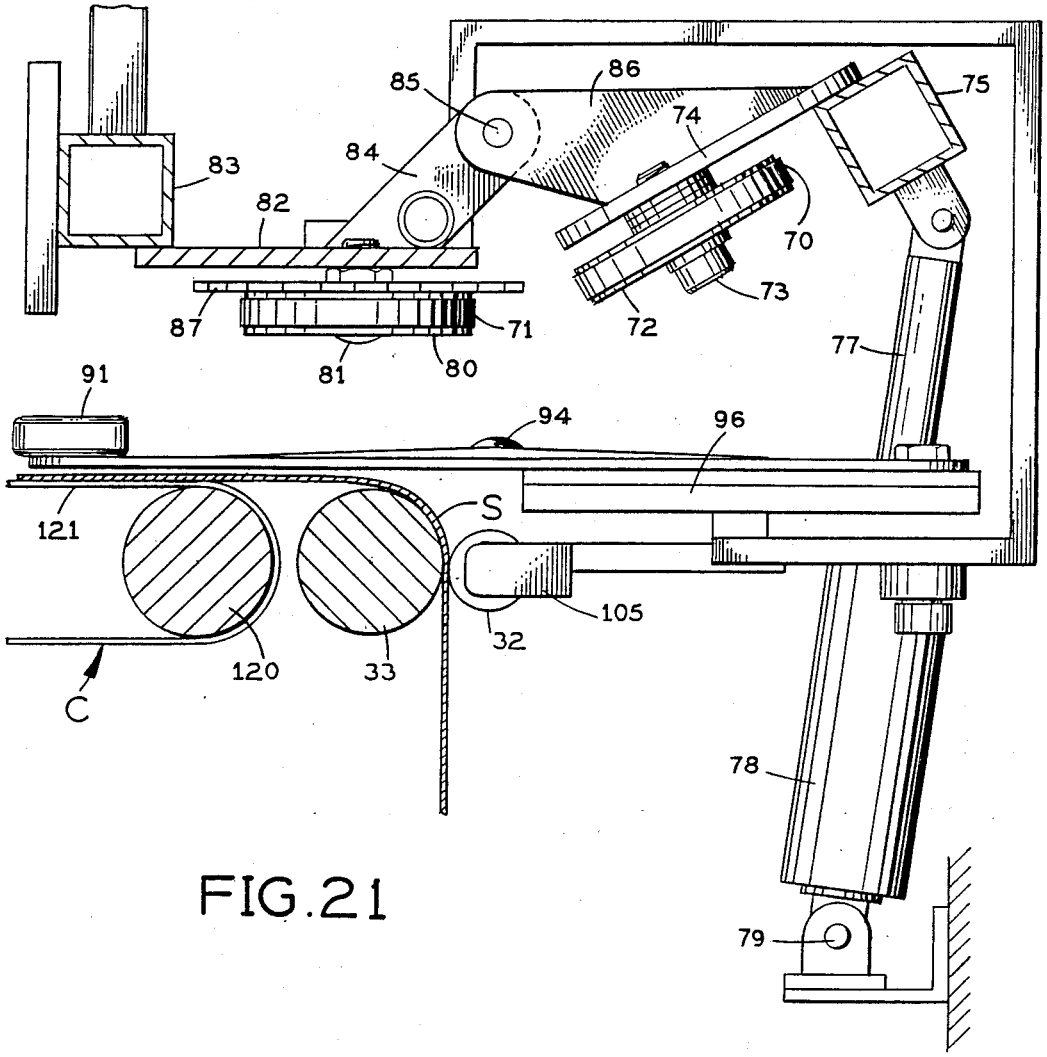
FIG. 21 is a fragmentary vertical cross-section showing one pair of the upper spreader belts in the machine, with the front belt of this pair retracted forwardly away from the rear belt.

FIG. 10 shows the normal position of the parts, with piston rod 77 retracted and cross-piece 75 and support plate 74 holding the front pulleys 70 in a horizontal, retracted position. FIG. 21 shows the position of the parts when piston rod 77 is extended due to air pressure in cylinder 78, raising the cross-piece 75 and tilting it and the support plate 74 counterclockwise to retract the front pulleys 72 away from the rear belt 71 in the direction toward the entry side of the machine.

The rear belt 71 passes across the front of a series of rear pulleys 80 and then across the back of these pulleys, which are spaced apart in close succession from left to right. The rear pulleys 80 are rotatably mounted individually on respective axles 81 which extend down from a horizontal support plate 82 (FIGS. 10 and 21) which is elongated from left to right. Behind the rear pulleys 80, support plate 82 is rigidly attached to the bottom of a fixedly positioned cross-piece 83. Plate 82 extends closely behind the support plate 74 for the front pulleys 72 when plate 74 is in its normal, raised position.

A pair of rigid linkage arms 84 (FIGS. 10 and 13) extend up and forward at an acute angle from the support plate 82 for the rear pulleys 80 near its opposite ends. Each arm 84 at its upper end is pivotally connected at 85 to the upper end of a pair of linkage arms 86 (FIGS, 3, 9 and 10) which extend up and rearward at an acute angle from the support plate 74 for the front pulleys 72. These linkage arms permit the movement of support plate 74 with respect to support plate 82 from the normal position (FIG. 2) to the retracted position of the front pulleys 72 relative to the rear pulleys 80.

At the left end of the rear belt 71, a toothed gripper wheel 87 is positioned directly above the pulley 80 there and rotates in unison with it. Referring to FIG. 9, the gripper wheel 87 rotates counterclockwise immediately above the top edges of belts 71 and 70. Each of its teeth has a radially disposed leading edge which makes a sharp corner with a convex trailing edge of that tooth, thereby forming a sharp tip on the outside of the wheel which securely engages the sheet S and moves it to the right as the toothed wheel continues to rotate. In the normal position of the parts (FIGS. 9 and 10), the toothed wheel can engage the sheet S just above belts 70 and 71 and force it between the back side of the front belt 70 and the front side of the rear belt 71, which grasp the sheet tightly between them as it moves past gripper wheel 87.

when the front pulleys 72 are displaced from the rear pulleys 80 (FIG. 21) in the direction toward the entry side of the machine, the sheet S drops from between the front and rear belts 70 and 71.

Figure 4:
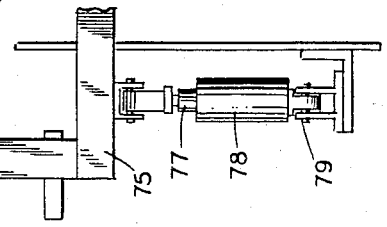
FIG. 4 is a fragmentary vertical cross-section taken along the line 4—4 in FIG. 3.

To the left of the centerline of the machine, the upper spreader belts B-1 and their pulleys, etc. are a mirror image of the arrangement just described for the upper belts B-2. Corresponding elements of belts B-1 are given the same reference numerals, with a "prime" suffix added, as those associated with belts B-2, so the detailed description of these elements need not be repeated. In FIGS. 4 and 9 the toothed gripper wheel 87' associated with belts B-1 rotates clockwise to force the sheet S between the back of the front belt 70' (behind its pulleys 72') and the front of the rear belt 71' (in front of its pulleys 80').

As shown in FIGS. 3 and 9, a nose 88 with a convex front tip extends along the longitudinal centerline of the machine between the upper belts B-1 and the upper belts B-2 extending respectively on opposite sides of this centerline. This nose projects in front of both pairs of belts to engage the sheet initially and it has oppositely inclined side faces 89 and 89' to guide the sheet toward the respective gripper wheels 87 and 87'.

Transfer Mechanism

FIGS. 10–15 show one of two identical pusher mechanisms in the present apparatus which together operate to transfer a sheet S onto the conveyor C immediately after the sheet is released by the upper spreader belts B-1 and B-2. This pusher mechanism includes a roller 32 for pinching the just-released sheet against a roller 33 immediately in front of conveyor C and a horizontally reciprocable linkage 90 above including a pusher bar for pushing the sheet away from the entry side of the machine and onto the conveyor. The mechanism shown in FIGS. 10–15 is located to the right of the centerline of the machine. Roller 33 is a "first pinch roller" and each roller 32 is a "second pinch roller" in this transfer mechanism.

Linkage 90 comprises a flat pusher bar 91 which is elongated from side-to-side of the machine and a pair of elongated flat arms 92 and 93 pivotally connected at 94 where they cross, midway along the length of each. Arm 92 is pivotally coupled at 95 to the pusher bar 91 near the left end of each of them. At its front end, arm 92 has a sliding pivotal connection to a flat horizontal base 96 below the linkage. This sliding pivotal connection is provided by a pin 97 (FIG. 14) extending down from arm 92 and slidably received in a slot 98 in base 96 which is elongated from side-to-side of the machine. Arm 93 is pivotally coupled to base 96 at 99, near the left end of arm 93. At its right end, arm 93 has a sliding pivotal connection to the pusher bar 91, which has a laterally elongated slot 100 that slidably receives a pin 101 extending down from arm 93.

An air cylinder 102 (FIGS. 13 and 14) below the base operates a piston rod 103 whose outer end is rotatably coupled at 104 to the pin 97 attached to arm 92 and forming part of the sliding pivotal connection between that arm and base 96. When piston rod 103 is in its normal retracted position (FIG. 13) it holds the linkage arms 92 and 93 collapsed (FIG. 12), thereby positioning the pusher bar 91 of the linkage retracted from the conveyor C in the direction of the entry side of the machine. When the air cylinder 102 is operated to extend its piston rod 103, the piston rod moves the right end of linkage arm 92 to the left, causing the linkage arms 92 and 93 to move to the extended position shown in FIG. 15, where the pusher bar 91 and part of the linkage arms 92 and 93 closely overlie the conveyor C near its front end.

Figure 13:
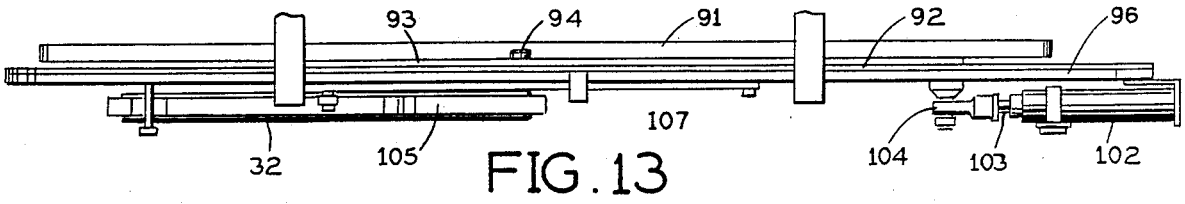
FIG. 13 is a front elevation of this pusher.
Figure 14:
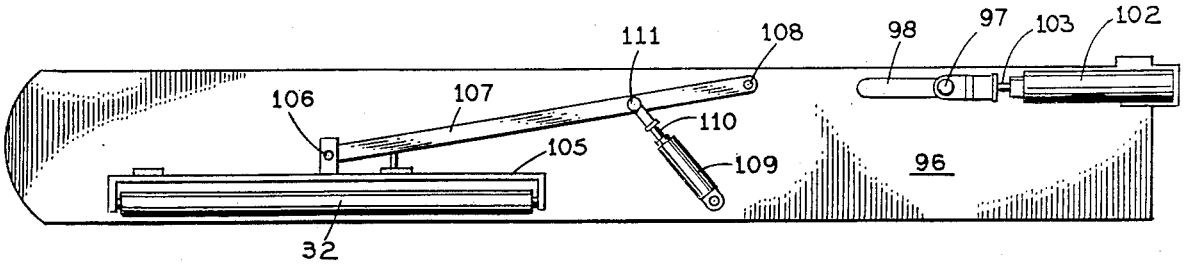
FIG. 14 is a bottom plan view of the FIG. 12 pusher.
Figure 15:
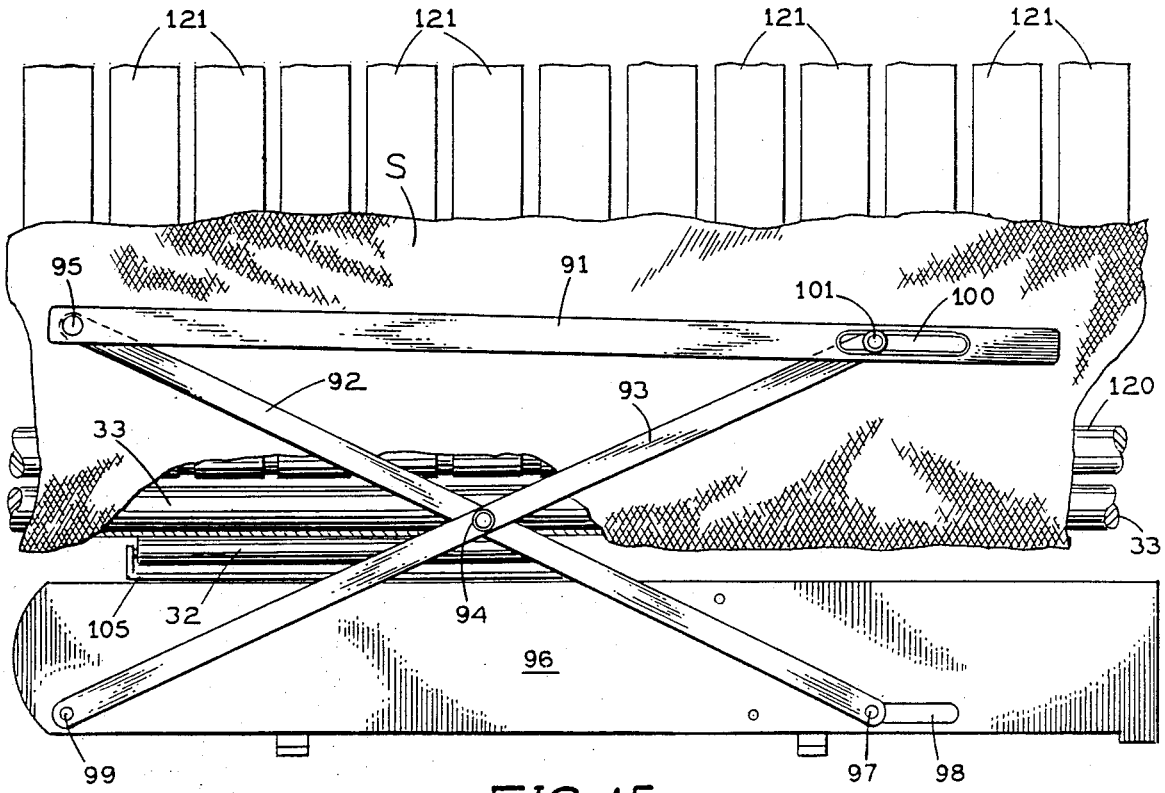
FIG. 15 is a top plan view showing this pusher in its extended condition to transfer a laundry workpiece onto the conveyor.

The pinch roller 32 is rotatably supported by a yoke 105 (FIGS. 13 and 14) below the base 96, as shown in FIGS. 13 and 14. Yoke 105 is reciprocable from front-to-back between a forward position beneath the base 96 (FIG. 10) and an extended position behind the rear edge of the base (FIG. 21). Yoke 105 is pivotally coupled at 106 (FIG. 14) to one end of an elongated rigid linkage arm 107 whose opposite end is pivoted at 108 to the base 96. An air cylinder 109 carried by the base has a piston rod 110 which is pivotally coupled at 111 to linkage arm 107 between its end. FIG. 14 shows piston rod 110 in its extended position, in which it holds the pinch roller 32 retracted below the base 96. When the air cylinder 109 is operated to pull in the piston rod 110, it moves the pinch roller 32 back past the rear edge of base 96, as shown in FIGS. 15 and 21.

Figure 11:
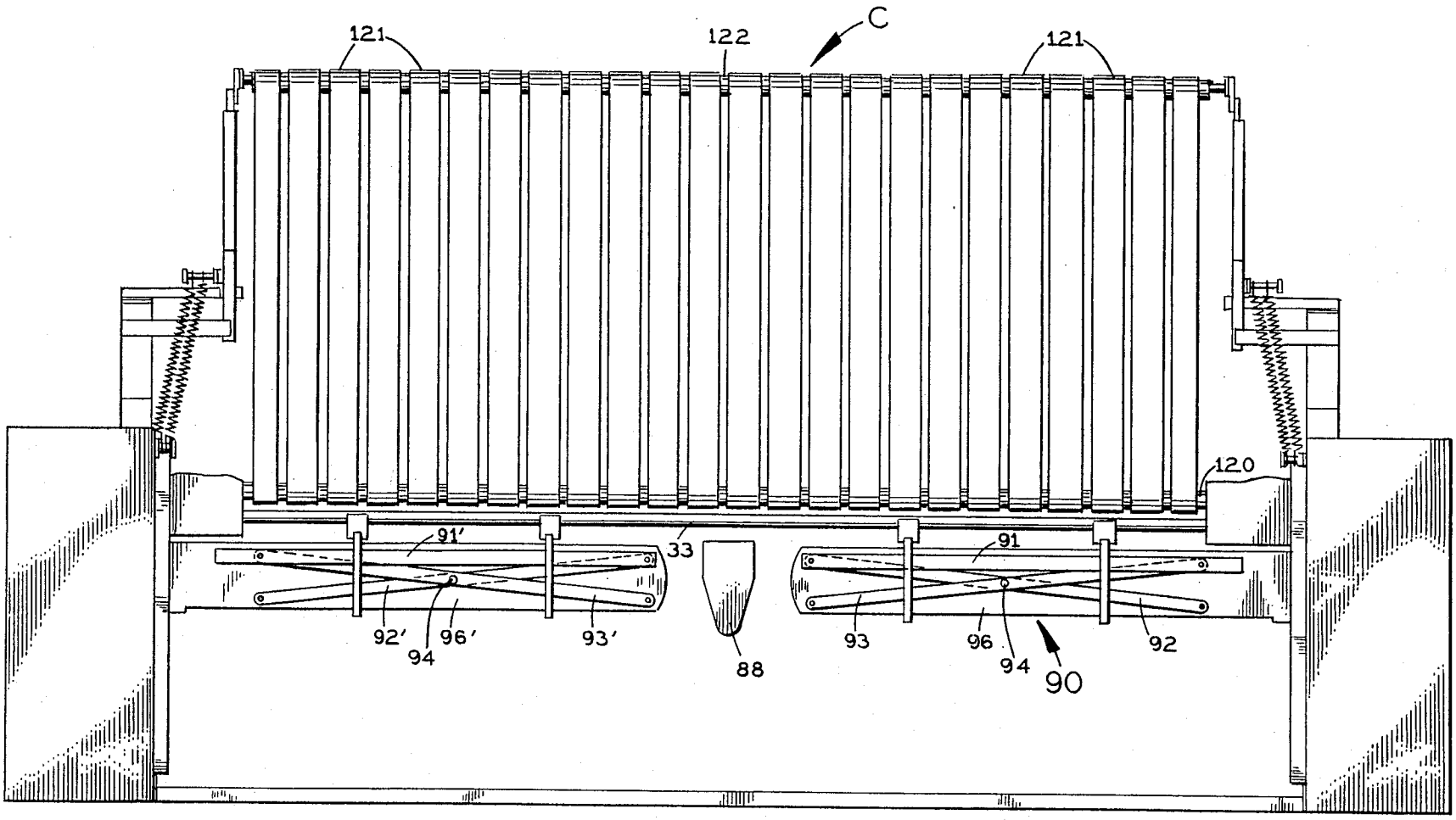
FIG. 11 is a view looking down on a conveyor and two pushers for depositing the laundry piece on the conveyor after it has been spread out.
Figure 12:
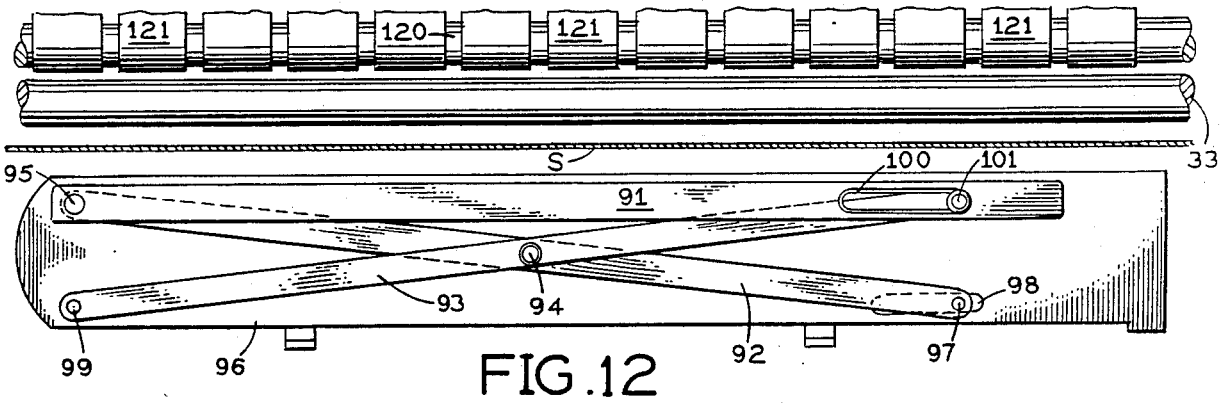
FIG.12 is an enlarged top plan view of one of the pushers in its normal retracted condition.

A similar pusher mechanism, which is a mirror image of the one just described, is located to the left of the centerline of the machine. In FIG. 11 elements of this mechanism are given the same reference numerals, but with a "prime" suffix added, as the corresponding elements in the just-described mechanism shown in FIGS. 10 and 12–15.

As shown in FIG. 11, the pinch roller 33 extends in front of conveyor C across the full width of the conveyor. Pinch roller 32 on the right side of the machine's centerline and the corresponding pinch roller on the opposite side are moved by their respective air cylinders in the direction away from the entry side of the machine to pinch the sheet S against roller 33 as soon as the sheet is released from the upper spreader belts B-1 and B-2. Substantially simultaneously with this action of the pinch rollers, the linkage mechanisms 91-92-93 and 91'-92'-93' on opposite sides of the machine's centerline are operated by their respective air cylinders to push the sheet onto conveyor C, as shown in FIG. 21.

Conveyor

Figure 7:
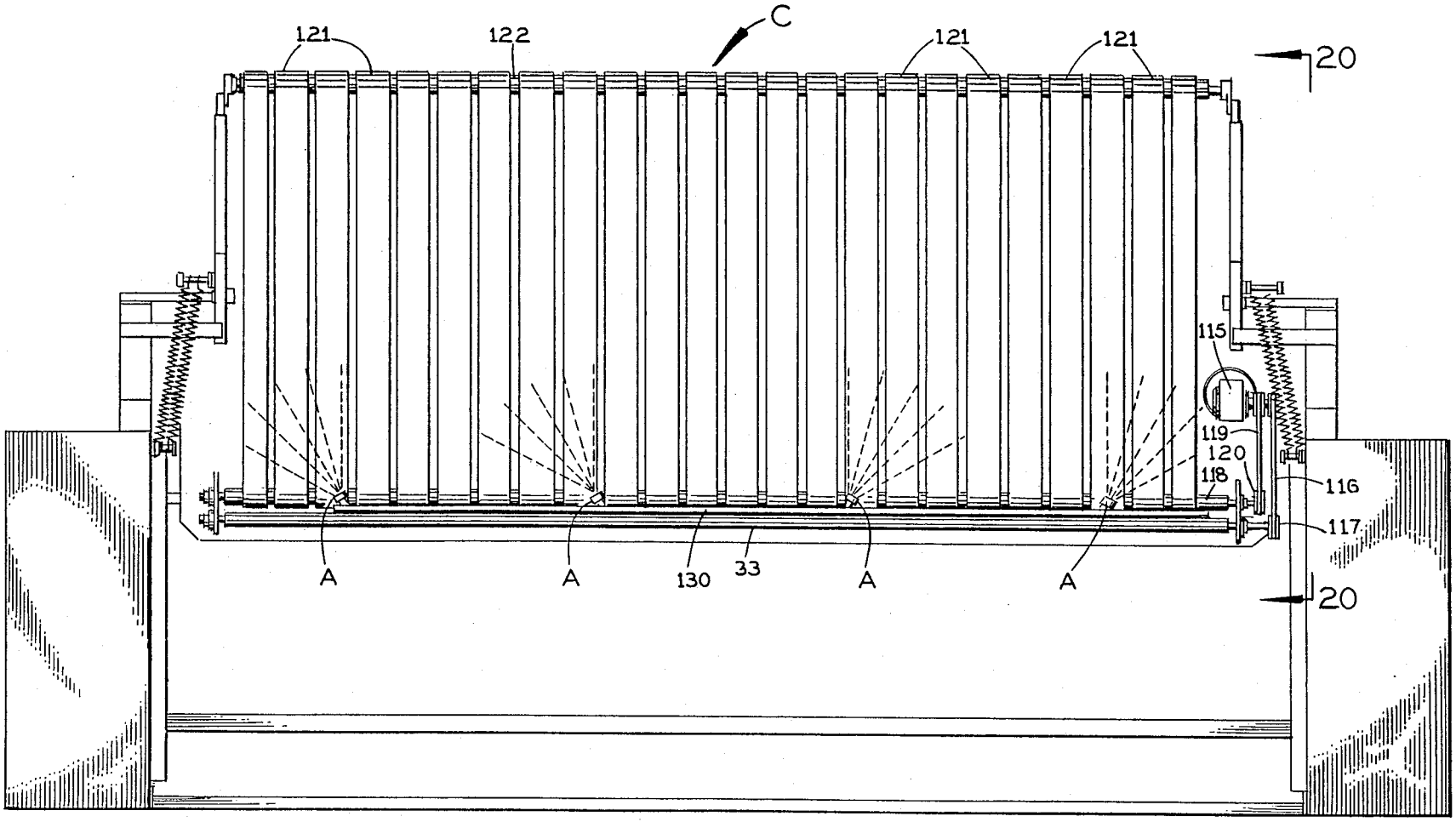
FIG. 7 is a horizontal longitudinal section taken along the line 7—7 in FIG. 1.
Figure 20:
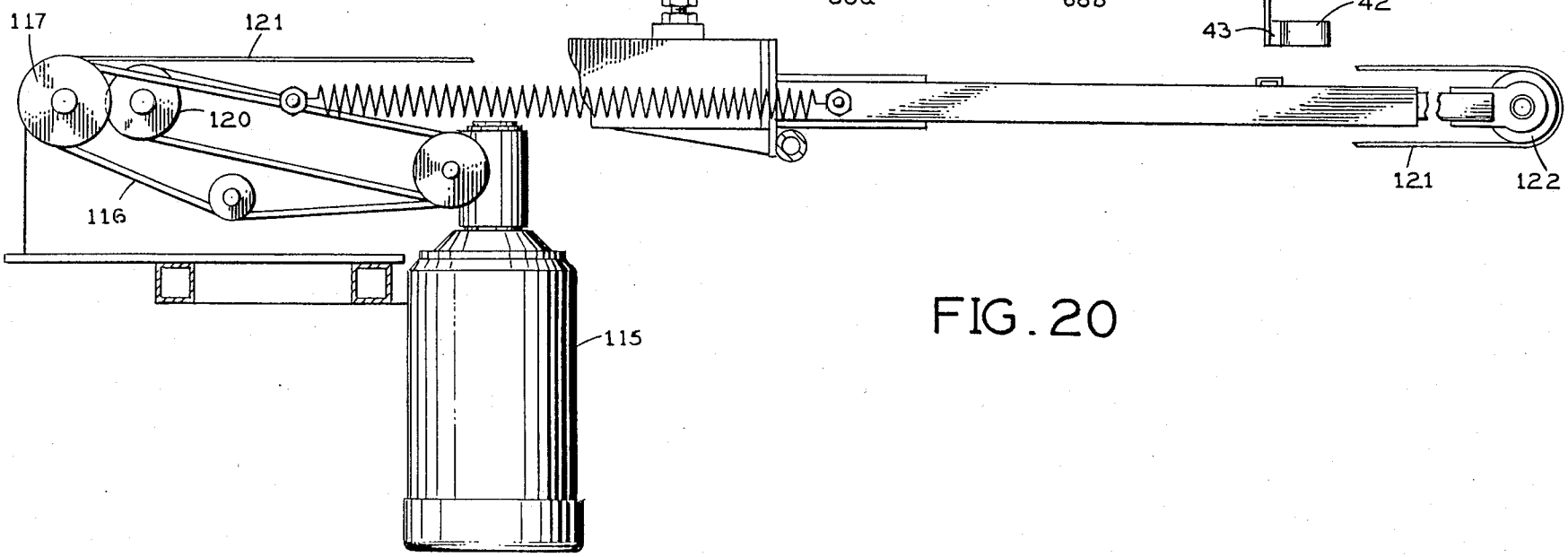
FIG. 20 is a fragmentary cross-section, taken along the line 20—20 in FIG. 7 and showing how the conveyor is driven.

The horizontal roller 33 immediately in front of conveyor C is driven from an electric motor 115 (FIGS. 7 and 20) through a belt 116 engaging a pulley 117 on the right end of roller 33.

The conveyor has a front roller 118 driven from motor 115 through a second belt 119 engaging a pulley 120 on the right end of roller 118. The conveyor has a plurality of closely spaced, endless, flexible belts 121 which pass around the front roller 118 and around a back roller 122 at the rear of the conveyor.

Four air nozzles A (FIG. 1) are spaced apart at intervals from side to side a short distance above the conveyor belts 121. A shown in FIG. 8, each of these air nozzles is located above the front roller 120 of the conveyor and a short distance below the fixed cross-piece 83. A horizontal air supply tube 130 (FIG. 7) supplies pressurized air to all of these nozzles A.

Air under pressure is supplied to the nozzles A in timed relationship to the depositing of the sheet S on the conveyor C, so that air is blown rearwardly across the top of the sheet on the conveyor to keep it flat and spread out across the conveyor.

Lower Spreader Belts

Figure 5:
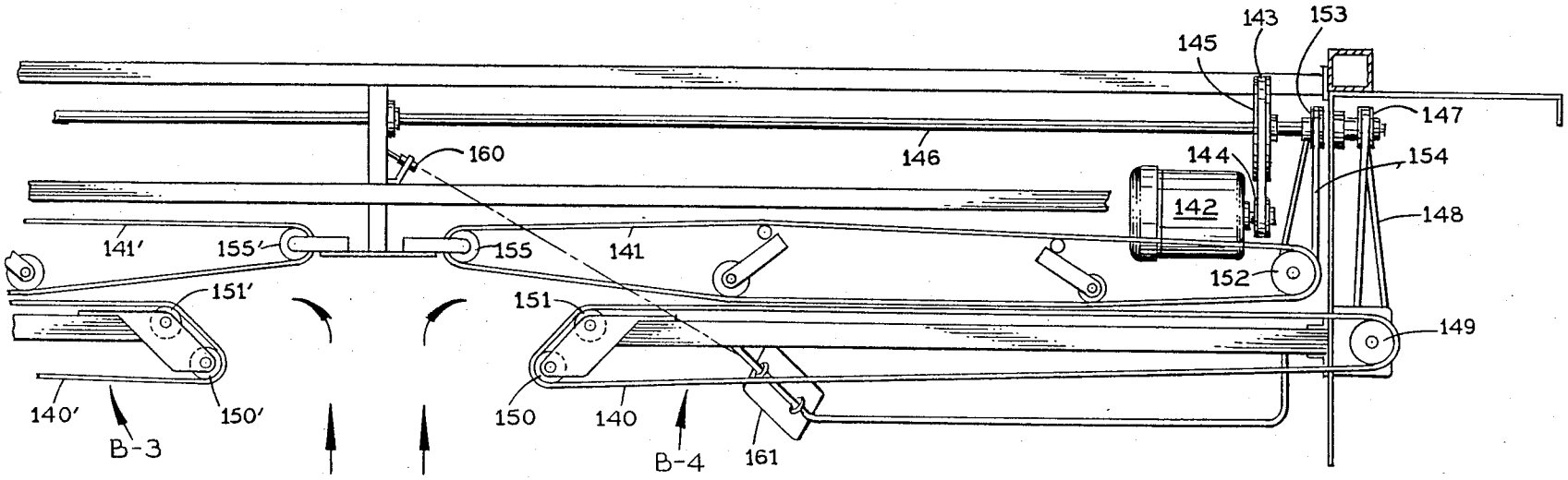
FIG. 5 is a horizontal longitudinal section taken along the line 5—5 in FIG. 1 and along the line 5—5 in FIG. 6.

FIG. 5 shows the pair B-4 of lower spreader belts on the right side of the centerline of the machine and part of the pair B-3 of lower belts on the left side of this centerline.

The belt pair B-4 comprises an endless flexible front belt 140 and an endless flexible rear belt 141, which extends laterally inward beyond front belt 140. Both of these belts are driven from an electric motor 142 through a belt 143 driven by a motor pulley 144 and driving a larger pulley 145 on an intermediate drive shaft 146.

Shaft 146 carries a first smaller pulley 147 which drives a belt 148 that drives a pulley (not shown) connected to a drive roller 149 at the right end of the front belt 140. The opposite, inner end of the front belt passes around a pair of fixedly supported idler rollers 150 and 151. The front roller 150 of this pair is positioned laterally inward from the rear roller 151 of the pair.

The rear belt 141 of this pair of belts has a drive roller 152 at its right end which is driven from shaft 146 through a pulley 153 on that shaft and an endless flexible belt 154. At its left end the rear belt 141 extends around a fixedly supported idler roller 155.

The other pair B-3 of lower spreader belts on the left side of the centerline of the machine is the mirror image of the right-hand pair B-4. Corresponding elements of the B-3 belt pair have the same reference numerals, with a "prime" suffix added, as those of the B-4 belt pair. The drive rollers (not shown) for the front belt 140' and the rear belt 141' of the B-3 pair are driven from intermediate drive shaft 146 in a manner similar to how the drive rollers for the belts 140 and 141 of the B-4 pair are driven.

Figure 6:
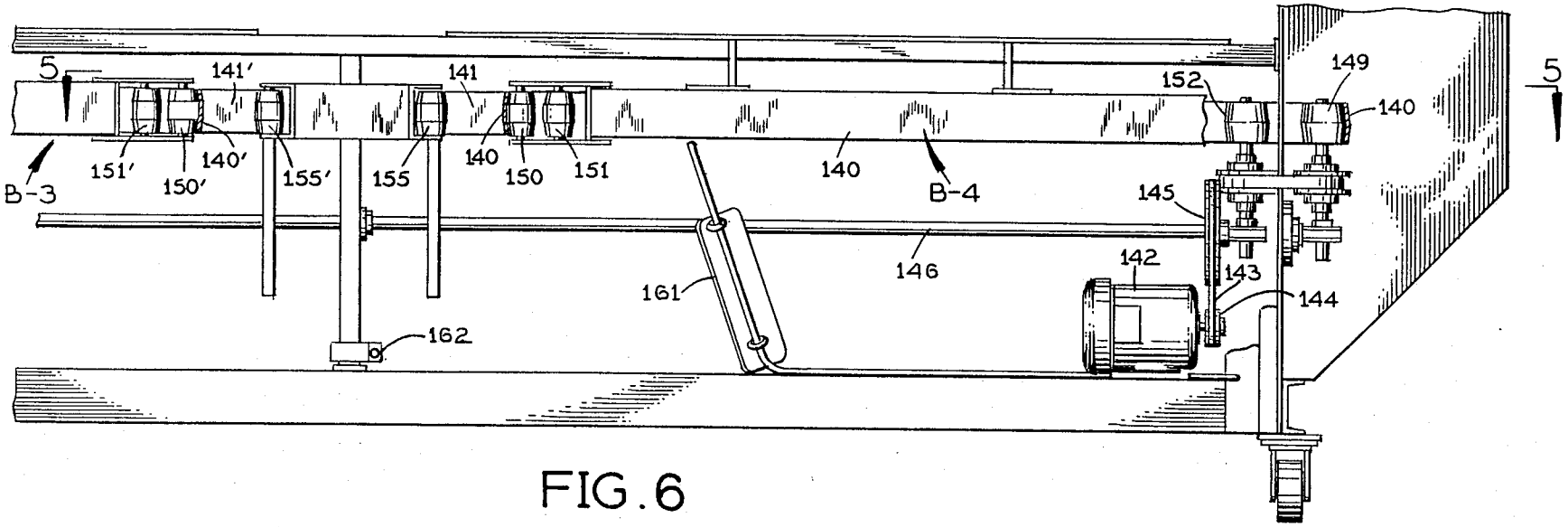
FIG. 6 is a front elevation of the mechanism shown in FIG. 5 with parts broken away for clarity.

Associated with the right-hand pair B-4 of lower spreader belts is a trailing edge sensor, which responds to the movement of the bottom edge of the laundry flatwork piece S up onto the conveyor C as the trailing edge of the spread-apart flatwork piece carried by the conveyor to the exit side of this apparatus. Referring to FIGS. 5 and 6, this trailing edge sensor has a light source 160 (FIG. 6) which directs a beam of light toward a reflector 161 and a photoelectric sensor 162 (FIG. 6) positioned to receive light reflected by reflector 161. The light source 160 is on the side of lower belts 140 and 141 toward the exit side of the present apparatus. The reflector 161 is on the side of the flatwork piece-engaging rear segment of the front belt 140 toward the entry side of the apparatus. Therefore, as long as a laundry flatwork piece S is hanging down from the lower spreader belts far enough to block the light source 160 from the reflector 161, the photoelectric sensor 162 will not be activated by light from the light source 160. As the bottom edge of the laundry flatwork piece moves up past the reflector 161, light from the source 160 will impinge on the sensor 162.

Operation

A worker inserts the opposite top corners 30 and 31 of a laundry flatwork piece S into the hangar which is at the entry side of the machine near its centerline, as shown in FIG. 22. This hanger carries the suspended flatwork piece into the machine away from its entry side and toward its exit side. The upper end of the suspended flatwork piece S engages the nose 88 (FIG. 3) and in sliding across the opposite side faces 89 and 89' of this nose it is guided toward the gripper wheels 87 and 87'. The gripper wheels carry the opposite side edges of the flatwork piece between the upper spreader belts B-1 and B-2 (FIG. 9), which spread the upper end of the flatwork piece. The lower spreader belts B-3 and B-4 engage and spread the flatwork piece about halfway down. When the flatwork piece is completely spread (FIG. 23), the upper spreader belts B-1 and B-2 release it and the pusher mechanisms (FIGS. 10–15) push it onto the conveyor C, which carries it toward the exit side of the machine, pulling its lower half up between the lower spreader belts B-3 and B-4 as the trailing part of the flatwork piece on the conveyor.

I claim:

1. In a spreader apparatus having an entry side and an exit side, and a conveyor located away from the entry side in the direction of the exit side of the apparatus and operative to carry a laundry flatwork piece away from the entry side in the direction of the exit side of the apparatus, the improvement which comprises:

hanger clamp means for releasably holding a laundry flatwork piece near its opposite top corners:

means for moving said hanger means in a predetermined path above the level of said conveyor away from the entry side of the apparatus and toward the exit side of the apparatus;

spreader means located above the conveyor and between the conveyor and said entry side of the apparatus, said spreader means being operative to spread said laundry flatwork piece in opposite directions laterally;

and transfer means located below said spreader means and operative, after said spreader means has spread said laundry flatwork piece, to deposit said laundry flatwork piece on said conveyor.

2. A spreader feeder apparatus according to claim 1 wherein said spreader means comprises:

a first set of spreader belts located above said conveyor and between said conveyor and the entry side of the apparatus, said first set of spreader belts extending completely on one side of said predetermined path of said hanger means, the spreader belts of said first set having respective contiguous segments for gripping the laundry flatwork piece between them which extend laterally out from said predetermined path of said hanger means;

a second set of spreader belts located above said conveyor and between said conveyor and the entry side of the apparatus, said second set of spreader belts extending completely on the opposite side of said predetermined path of said hanger means, the spreader belts of said second set having respective contiguous segments for gripping the laundry flatwork piece between them which extend laterally from said predetermined path of said hanger means;

drive means for driving said first and second sets of spreader belts to spread the laundry flatwork piece in opposite directions laterally;

and means for separating the spreader belts of said first set and for separating the spreader belts of said second set to release the laundry flatwork piece after it has been spread.

3. A spreader feeder apparatus according to claim 2 wherein said transfer means comprises:

a first pusher mechanism located below said first set of spreader belts on said one side of said predetermined path of said hanger means;

and a second pusher mechanism located below said second set of spreader belts on said opposite side of said predetermined path of said hanger means;

said first and second pusher mechanisms being operative to engage the laundry flatwork piece and push it onto the conveyor when it is released by said first and second sets of spreader belts.

4. A spreader feeder apparatus according to claim 3 wherein said spreader means also comprises:

a third set of spreader belts located below said first pusher mechanism and between said conveyor and the entry side of the apparatus, said third set of spreader belts extending completely on said one side of said predetermined path of said hanger means, the spreader belts of said third set having respective contiguous segments for gripping the laundry flatwork piece between them which extend laterally out from said predetermined path of said hanger means;

a fourth set of spreader belts located below said second pusher mechanism and between said conveyor and the entry side of the apparatus, said fourth set of spreader belts extending completely on said opposite side of said predetermined path of said hanger means, the spreader belts of said fourth set having respective contiguous segments for gripping the laundry flatwork piece between them which extend laterally out from said predetermined path of said hanger means;

and drive means for driving said third and fourth sets of spreader belts to spread the laundry flatwork piece in opposite directions laterally while it is being spread by said first and second sets of spreader belts.

5. A spreader feeder apparatus according to claim 2 wherein said spreader means also comprises:

a third set of spreader belts extending below said first set of spreader belts completely on said one side of said predetermined path of said hanger means at a level below said transfer means, the spreader belts of said third set having respective contiguous segments for gripping the laundry flatwork piece between them which extend laterally out from said predetermined path of said hanger means;

a fourth set of spreader belts extending below said second set of spreader belts completely on said opposite side of said predetermined path of said hanger means at a level below said transfer means, the spreader belts of said fourth set having respective contiguous segments for gripping the laundry flatwork piece between them which extend laterally out from said predetermined path of said hanger means;

and drive means for driving said third and fourth sets of spreader belts to spread the laundry flatwork piece in opposite directions laterally while it is being spread by said first and second sets of spreader belts.

6. A spreader feeder apparatus according to claim 1 wherein said transfer means comprises:

a first pusher mechanism located below said spreader means on one side of said predetermined path of said hanger means;

a second pusher mechanism located below said spreader means on the opposite side of said predetermined path of said hanger means;

and means for actuating said first and second pusher mechanisms to engage the laundry flatwork piece, after it has been spread by said spreader means, and push it onto the conveyor.

7. A spreader feeder according to claim 6 and further comprising a first pinch roller extending in close proximity across the end of said conveyor which faces the entry side of the apparatus, and wherein each of said first and second pusher mechanisms comprises:

a reciprocable pinch roller movable toward and away from said first pinch roller;

means for moving said reciprocable pinch roller toward said first pinch roller to pinch between them the laundry flatwork piece spread by said first and second sets of upper and lower spreader belts;

a pusher bar mounted above said reciprocable pinch roller for movement slightly above the level of the top of the conveyor;

and means for moving said pusher bar over the conveyor toward the exit side of the apparatus to engage the laundry flatwork piece spread by said first and second sets of upper and lower spreader belts and pinched between said first pinch roller and said reciprocable pinch rollers of said pusher mechanisms and push said laundry flatwork piece down onto the conveyor.

8. A spreader feeder apparatus according to claim 1 wherein said spreader means in spreading said laundry flatwork piece pulls said flatwork piece free of said hanger means.

9. A spreader feeder apparatus according to claim 8 wherein said spreader means comprises:

a first set of spreader belts located above said conveyor and between said conveyor and the entry side of the apparatus, said first set of spreader belts extending completely on one side of said predetermined path of said hanger means, the spreader belts of said first set having respective contiguous segments for gripping the laundry flatwork piece between them which extend laterally out from said predetermined path of said hanger means;

a second set of spreader belts located above said conveyor and between said conveyor and the entry side of the apparatus, said second set of spreader belts extending completely on the opposite side of said predetermined path of said hanger means, the spreader belts of said second set having respective contiguous segments for gripping the laundry flatwork piece between them which extend laterally from said predetermined path of said hanger means;

drive means for driving said first and second sets of spreader belts to spread the laundry flatwork piece in opposite directions laterally;

and means for separating the spreader belts of said first set and for separating the spreader belts of said second set to release the laundry flatwork piece after it has been spread.

10. A spreader feeder apparatus according to claim 9 wherein said transfer means comprises:

a first pusher mechanism located below said first set of spreader belts on said one side of said predetermined path of said hanger means;

and a second pusher mechanism located below said second set of spreader belts on said opposite side of said predetermined path of said hanger means;

said first and second pusher mechanisms being operative to engage the laundry flatwork piece and push it onto the conveyor when it is released by said first and second sets of spreader belts.

11. A spreader feeder apparatus according to claim 10 wherein said spreader means also comprises:

a third set of spreader belts located below said first pusher mechanism and between said conveyor and the entry side of the apparatus, said third set of spreader belts extending completely on said one side of said predetermined path of said hanger means, the spreader belts of said third set having respective contiguous segments for gripping the laundry flatwork piece between them which extend laterally out from said predetermined path of said hanger means;

a fourth set of spreader belts located below said second pusher mechanism and between said conveyor and the entry side of the apparatus, said fourth set of spreader belts extending completely on said opposite side of said predetermined path of said hanger means, the spreader belts of said fourth set having respective contiguous segments for gripping the laundry flatwork piece between them which extend laterally out from said predetermined path of said hanger means;

and drive means for driving said third and fourth sets of spreader belts to spread the laundry flatwork piece in opposite directions laterally while it is being spread by said first and second set of spreader belts.

12. A spreader feeder apparatus according to claim 9 wherein sad spreader means also comprises:

a third set of spreader belts extending below said first set of spreader belts completely on said one side of said predetermined path of said hanger means at a level below said transfer means, the spreader belts of said third set having respective contiguous segments for gripping the laundry flatwork piece between them which extend laterally out from said predetermined path of said hanger means;

a fourth set of spreader belts extending below said second set of spreader belts completely on said opposite side of said predetermined path of said hanger means at a level below said transfer means, the spreader belts of said fourth set having respective contiguous segments for gripping the laundry flatwork piece between them which extend laterally out from said predetermined path of said hanger means;

and drive means for driving said third and fourth sets of spreader belts to spread the laundry flatwork piece in opposite directions laterally while it is being spread by said first and second sets of spreader belts.

13. A spreader feeder apparatus according to claim 8 wherein said transfer means comprises:

a first pusher mechanism located below said spreader means on one side of said predetermined path of said hanger means;

a second pusher mechanism located below said spreader means on the opposite side of said predetermined path of said hanger means;

and means for actuating said first and second pusher mechanisms to engage the laundry flatwork piece, after it has been spread by said spreader means, and push it onto the conveyor.

14. A spreader feeder according to claim 13 and further comprising a first pinch roller extending in close proximity across the end of said conveyor which faces the entry side of the apparatus, and wherein each of said first and second pusher mechanisms comprises:

a reciprocable pinch roller movable toward and away from said first pinch roller;

means for moving said reciprocable pinch roller toward said first pinch roller to pinch between them the laundry flatwork piece spread by said first and second sets of upper and lower spreader belts;

a pusher bar mounted above said reciprocable pinch roller for movement slightly above the level of the top of the conveyor;

and means for moving said pusher bar over the conveyor toward the exit side of the apparatus to engage the laundry flatwork piece spread by said first and second sets of upper and lower spreader belts and pinched between said first pinch roller and said reciprocable pinch rollers of said pusher mechanisms and push said laundry flatwork piece down onto the conveyor.

15. In a spreader feeder apparatus having an entry side and an opposite exit side, and a conveyor located away from said entry side in the direction of said exit side of the apparatus, said conveyor being operative to carry a laundry flatwork piece generally horizontally toward the exit side of the apparatus, the improvement which comprises:

spreader means located above the conveyor and between the conveyor and said entry side of the apparatus, said spreader means being operative to releasably engage said laundry flatwork piece and spread it in opposite directions laterally;

means for causing said spreader means to release said laundry flatwork piece after spreading it;

and transfer means located below said spreader means and operative when said spreader means releases said laundry flatwork piece, to deposit said laundry flatwork piece on said conveyor;

said transfer means comprising:

a first pinch roller extending in close proximity across the end of said conveyor facing the entry side of the apparatus;

a second pinch roller movable toward and away from said first pinch roller;

means for moving said second pinch roller toward said first pinch roller to pinch between them the laundry flatwork piece spread by said spreader means;

a pusher bar mounted above said second pinch roller for movement slightly above the level of the top of the conveyor;

and means for moving said pusher bar over the conveyor in the direction of the exit end of the apparatus to engage the laundry flatwork piece spread and released by said spreader means and pinched between said first and second pinch rollers to push said laundry flatwork piece down onto the conveyor.

16. In a spreader feeder apparatus having a longitudinal centerline, an entry side and an opposite exit side, and a conveyor located away from said entry side in the direction of said exit side of the apparatus, said conveyor being operative to carry a laundry flatwork piece generally horizontally toward the exit side of the apparatus, the improvement which comprises:

a first set of spreader belts located above said conveyor and between said conveyor and the entry side of the apparatus, said first set of spreader belts extending completely on one side of said centerline of the apparatus, said spreader belts of said first set having respective contiguous segments for gripping the laundry flatwork piece between them which extend laterally out from said centerline of the apparatus;

a second set of spreader belts located above said conveyor and between said conveyor and the entry side of the apparatus, said second set of spreader belts extending completely on the opposite side of said centerline of the apparatus, said spreader belts of said second set having respective contiguous segments for gripping the laundry flatwork piece between them which extend laterally out from said centerline of the apparatus;

drive means for driving said first and second sets of spreader belts to spread the laundry flatwork piece in opposite directions laterally;

means for causing said first and second sets of spreader belts to release said laundry flatwork piece after spreading it;

and transfer means operative when said first and second sets of spreader belts release said laundry flatwork piece to deposit said laundry flatwork piece on said conveyor, said transfer mechanism comprising a first pinch roller extending in close proximity across the end of said conveyor which faces the entry side of the apparatus, a first pusher mechanism located below said first set of spreader belts, and a second set of spreader belts;

each of said pusher mechanisms comprising:

a reciprocable pinch roller movable toward and away from said first pinch roller;

means for moving said reciprocable pinch roller toward said first pinch roller to pinch between them the laundry flatwork piece spread by said first and second sets of spreader belts;

a pusher bar mounted above said reciprocable pinch roller for movement slightly above the level of the top of the conveyor;

and means for moving said pusher bar over the conveyor toward the exit end of the apparatus to engage the laundry flatwork piece spread and released by said first and second sets of spreader belts and pinched between said first pinch roller and said reciprocable pinch rollers of said pusher mechanisms and push said laundry flatwork piece down onto the conveyor.

17. In a spreader feeder apparatus having an entry side and an exit side, and a conveyor located away from the entry side in the direction of the exit side of the apparatus and operative to carry a laundry flatwork piece away from the entry side in the direction of the exit side of the apparatus, the improvement which comprises:

a hanger having means for clampingly engaging a laundry flatwork piece near its opposite top corners;

means for moving said hanger in a predetermined path above said conveyor away from said entry side of the apparatus and toward the exit side of the apparatus;

a first set of upper endless spreader belts located above said conveyor and between said conveyor and the entry side of the apparatus, said first set of upper spreader belts extending completely on one side of said predetermined path of said hanger, said spreader belts of said first upper set having respective continuous segments for gripping the laundry flatwork piece between them which extend laterally out from said predetermined path of said hanger;

a second set of upper spreader belts located above said conveyor and between said conveyor the entry side of the apparatus, said second set of upper spreader belts extending completely on the opposite side of said predetermined path of said hanger, said spreader belts of said second upper set having respective contiguous segments for gripping the laundry flatwork piece between them which extend laterally out from said predetermined path of said hanger;

drive means for driving said first and second sets of upper spreader belts to spread the laundry flatwork piece in opposite directions laterally;

means for causing said first and second sets of upper spreader belts to release said laundry flatwork piece after spreading it;

a first set of lower spreader belts located below said first set of upper spreader belts and between said conveyor and the entry side of the apparatus, said first set of lower spreader belts extending completely on said one side of said predetermined path of said hanger, said spreader belts of said first lower set having respective contiguous segments for gripping the laundry flatwork piece between them which extend laterally out from said predetermined path of said hanger;

a second set of lower spreader belts located below said second set of upper spreader belts and between said conveyor and the entry side of the apparatus, said second set of lower spreader belts extending completely on said opposite side of said predetermined path of the hanger, said spreader belts of said second lower set having respective contiguous segments for gripping the laundry flatwork piece between them which extend laterally out from said predetermined path of said hanger;

drive means for driving said first and second sets of lower spreader belts to spread the laundry flatwork piece in opposite directions laterally;

a first pusher mechanism located between said first set of upper spreader belts and said first set of lower spreader belts on said one side of said predetermined path of the hanger;

and a second pusher mechanism located between said second set of upper spreader belts and said second set of lower spreader belts on said opposite side of said predetermined path of the hanger;

said first and second pusher mechanisms being operative to engage the laundry flatwork piece and push it onto the conveyor when it is released by said first and second sets of upper spreader belts.

* * * * *